US006194717B1

(12) United States Patent
Hager

(10) Patent No.: US 6,194,717 B1
(45) Date of Patent: Feb. 27, 2001

(54) QUADRUPOLE MASS ANALYZER AND METHOD OF OPERATION IN RF ONLY MODE TO REDUCE BACKGROUND SIGNAL

(75) Inventor: James W. Hager, Mississauga (CA)

(73) Assignee: MDS Inc., Concord (CA)

( * ) Notice: Subject to any disclaimer, the term of this patent is extended or adjusted under 35 U.S.C. 154(b) by 0 days.

(21) Appl. No.: 09/238,549

(22) Filed: Jan. 28, 1999

(51) Int. Cl.[7] ..... H01J 49/42
(52) U.S. Cl. ..... 250/292; 250/282
(58) Field of Search ..... 250/292, 282

(56) References Cited

U.S. PATENT DOCUMENTS

| | | | | |
|---|---|---|---|---|
| 4,090,075 | | 5/1978 | Brinkmann | 250/282 |
| 4,137,750 | | 2/1979 | French et al. | 73/23 |
| 4,189,640 | | 2/1980 | Dawson | 250/290 |
| 4,963,736 | | 10/1990 | Douglas et al. | 250/292 |
| 5,248,875 | | 9/1993 | Douglas et al. | 250/282 |
| 5,652,427 | * | 7/1997 | Whitehouse et al. | 250/282 |
| 5,942,752 | * | 8/1999 | Wang | 250/292 |
| 6,028,308 | * | 2/2000 | Hager | 250/282 |
| 6,093,929 | * | 7/2000 | Javahery et al. | 250/282 |

FOREIGN PATENT DOCUMENTS

| | | |
|---|---|---|
| 0 373 835 | 6/1990 | (EP) . |
| WO 98/22972 | 5/1998 | (WO) . |
| WO 98/52209 | 11/1998 | (WO) . |
| WO 98/56030 | 12/1998 | (WO) . |

* cited by examiner

*Primary Examiner*—Jack Berman
(74) *Attorney, Agent, or Firm*—Bereskin & Parr

(57) ABSTRACT

A method of and apparatus for mass analysis utilizes two quadrupole rod sets located in a vacuum chamber, this first rod set is intended to collimate the ions with an RF-only voltage. An RF-only voltage to the second quadrupole rod set and this is operated so that desired ions having a mass-to-charge ratio giving a q value of substantially 0.907 gain additional axial kinetic energy upon leaving the second quadrupole rod set. These desired ions are then detected by separating the ions with increased axial kinetic energy. It has been discovered that the pressure within the first quadrupole rod can be adjusted to enhance separation between ions gaining the additional axial kinetic energy and other ions, the pressure times the length in the first quadrupole rod set can be in the range $4\times10^{-2}$ torr-cm. to $1.6\times10^{-1}$ torr-cm.

21 Claims, 8 Drawing Sheets

RF-Only Ion Energy Distributions

QUADRUPOLE MASS ANALYZER AND METHOD OF OPERATION IN RF ONLY MODE TO REDUCE BACKGROUND SIGNAL

FIELD OF THE INVENTION

This invention relates to quadrupole mass analyzers, and more particularly is concerned with quadrupole mass analyzers operated in an RF only mode which provides mass resolution, with a reduced background signal.

BACKGROUND OF THE INVENTION

Quadrupole mass spectrometers have proven to be useful as general purpose mass analyzers. These devices are four rod structures and when designed for operation in a resolving mode are usually about 20 cm in length and require extreme mechanical precision in terms of fabrication and alignment. When operated in a resolving mode quadrupole mass spectrometers conventionally have both RF and DC voltages applied to them. Values of these voltages vary with the frequency and mass range of operation, but can be on the order of 1600 volts (peak-to-peak) RF for operation at 1 MHz and ±272 volts DC for a rod array inscribed radius $r_0$ of 0.418 cm and a mass range of 600 Daltons. The high degrees of mechanical and electrical sophistication required means that the costs of these mass spectrometers are high.

The most common mode of operation teaches that the operating line q should cross just below the tip of the first stability region. The stability region is plotted as a function of the well-known Mathieu parameters a and q. Operation at the tip of the first stability region means that only ions with a narrow range of m/z will be transmitted, giving the potential for high mass resolution.

In theory operation with no applied DC voltage equates to operation along the horizontal axis of the Mathieu stability diagram and this should give transmission of a wide range of ions up to an m/z given by the limit of the first stability region.

However, as taught in U.S. Pat. No. 4,090,075, a quadrupole rod array can provide mass resolution in the absence of applied resolving DC voltages. This so called RF-only mode of operation has several advantages over conventional RF/DC operational modes. Conventional RF/DC quadrupole rod mass spectrometers supply mass resolution based on the intrinsic stability or instability of given ions within the rod structure in the combination of the time varying RF and the time independent DC fields. In contrast to the more common RF/DC quadrupole mass analyzers, mass resolution for an RF-only instrument is thought to occur when ions that are only marginally stable with a particular applied RF voltage gain excess axial kinetic energy in the exit fringing field of the rod structure. Since a large part of the phenomena leading to mass resolution of an RF-only mass analyzer occurs at the exit of the rod array the length limitations characteristic of RF/DC resolving quadrupoles no longer apply and mechanical tolerances for rod roundness and straightness are considerably relaxed. Finally, there is no need for a high precision high voltage DC power supply in the RF-only mode of operation. Taken together the inherent advantages of RF-only operation suggest the opportunity for a much smaller and less costly mass analyzer than conventional RF/DC quadrupoles. Although the potential of such a device is significant problems such as sample dependent background from high velocity ions and clusters have considerably limited the commercial use of RF-only mass analyzers, especially when coupled with electrospray and other atmospheric pressure ion sources.

In the RF-only mode, to separate out ions with higher energies, energy filtering is accomplished, typically by placement of a retarding grid either at the exit of the quadrupole or further downstream. This has the effect of separating particles having higher energy, i.e. those ions with a q near 0.907 which have acquired a higher kinetic energy, from other ions with lower kinetic energy.

A drawback associated with this energy filtering technique is that there can be a significant high energy tail in the energy distribution of ions entering the quadrupole rods, i.e. ions with a q substantially less than 0.907. These high energy ions can originate from a variety of sources, but the net effect is overlap of the energy distribution of these ions, and of the curve representing ions with a q of near 0.907. This in turn results in the appearance of a continuum background signal upon which overlaps the peaks of the ions with a q near 0.907.

One technique proposed for reducing this background is in U.S. Pat. No. 4,189,640. This teaches providing a centrally located attractively biased disk of appropriate size, located after the analyzing quadrupole. The intention is to reduce high velocity and higher mass species. However, in practice this also reduces analyte ion intensity off-setting much of the expected gains in signal-to-noise ratio.

SUMMARY OF THE PRESENT INVENTION

In accordance with a first aspect of the present invention, there is provided a method of mass analysis utilizing a quadrupole rod set located in a vacuum chamber, the method comprising:

A method of mass analysis utilizing a quadrupole rod set located in a vacuum chamber, the method comprising:

(1) providing a stream of ions and supplying the stream of ions to one end of a first multipole rod set;

(2) supply an RF-only voltage to the multipole rod set, whereby the first multipole rod set acts as an ion guide and transmits desired ions therethrough;

(3) passing the ions into an analyzing quadrupole rod set;

(4) supplying an RF-only voltage to the analyzing quadrupole rod set, whereby desired ions having a mass-to-charge ratio giving a q value of substantially 0.907 gain additional axial kinetic energy upon leaving the analyzing quadrupole rod set;

(5) detecting ions leaving the analyzing quadrupole rod set having the increased axial kinetic energy; and (6) selecting the pressure within the first multipole rod set to enhance separation between ions gaining the additional axial kinetic energy and other ions.

Preferably, step (5) comprises:

(a) passing ions leaving the analyzing quadrupole rod set through an energy filter, whereby only ions with additional axial kinetic energy have sufficient energy to pass through the energy filter; and (b) detecting ions passing through the energy filter at a detector.

The multipole rod set can comprise a first quadrupole rod set. Then, the gas pressure provided in the first quadrupole or other multipole rod set can be such that the multiple of the pressure in the rod set times the length of the rod set is at least $4\times10^{-2}$ torr-cm, preferably at least $10^{-1}$ torr-cm, and more preferably equal to or greater than $1.6\times10^{-1}$ torr-cm. The first quadrupole rod set can then be 10 cm long.

In accordance with another aspect of the present invention, there is provided an apparatus for mass analysis of an ion stream, the apparatus comprising:

a generation means for generating a stream of ions;

a multipole rod set connected to the generation means for receiving ions and for collimating and cooling ions;

an analyzing quadrupole rod set having an inlet for the ion stream from the multipole rod set and an outlet;

a means for maintaining a variable pressure in the multipole rod set and adjusting the pressure to improve separation, in the analyzing quadrupole rod set, between ions with a q of substantially 0.907 and other ions, the ions having a q of substantially 0.907 gaining axial kinetic energy on leaving the outlet of the analyzing quadrupole rod set; and a means for detecting the ions having the additional axial kinetic energy, whereby ions having the higher axial kinetic energy are resolved with respect to other ions.

BRIEF DESCRIPTION OF THE DRAWINGS

For a better understanding of the present invention and to show more clearly how it may be carried into effect, reference will now be made, by way of example, to the accompanying drawings in which.

DESCRIPTION OF THE PREFERRED EMBODIMENT

Figure 1:
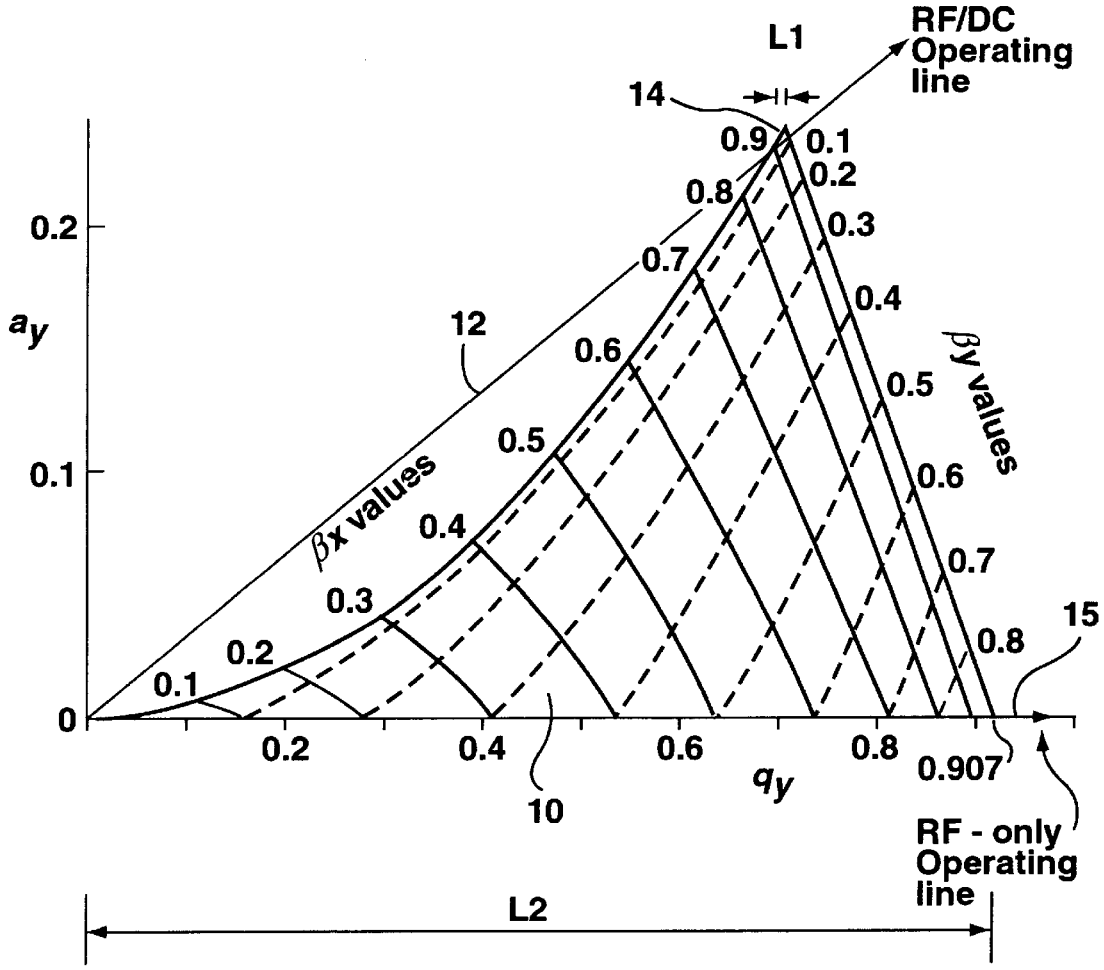
FIG. 1 is a graph showing the operating diagram of a quadrupole mass spectrometer.

Referring to FIG. 1, this shows the well known operating diagram for a quadrupole mass spectrometer; the a parameter is plotted on the vertical axis and the q parameter on the horizontal axis, where:

$$a=8eU/(m\omega^2 r_0^2)$$

$$q=4eV/(m\omega^2 r_0^2) \quad (1)$$

U is the amplitude of the DC voltage applied to the rods, V is the RF voltage applied to the rods, e is the charge on the ion, m is its mass, ω is the RF frequency, and $r_0$ is the inscribed radius of the rod set. In the FIG. 1 operating diagram ions within the shaded area 10 are stable provided they are above the operating line and have a and q values within the stability diagram. In the conventional RF/DC operation the RF/DC ratio is kept constant and is indicated by an operating line 12. For high resolution, operating line 12 is made to lie near the apex 14 of the first stability regional shown in the operating diagram. The theoretical resolution of such a device is given by the width L1 of the peak above the operating line divided by the width L2 of the base of the operating diagram. This requires substantial RF and DC voltages be applied to the rods. In theory very high mass resolution is possible with RF/DC quadrupoles operating near the tip of the stability diagram, but this requires extremely high mechanical precision of the dimensions of the rod structure and high precision control of the RF voltage, the DC voltage, and the RF/DC ratio. Degradation of any of these high tolerances directly affects the mass resolving capabilities of the device and can lead to poor analytical performance.

Operation of a quadrupole in RF-only mode (that is without DC) results in the operating line in FIG. 1 being along the horizontal axis as indicated at 15. Thus, the device acts essentially as an ion pipe and a very wide range of ions with q<~0.907 are stable. Ions with a q value above ~0.907 become radially unstable, hit the rods, and are not transmitted.

Mass resolution of an RF-only quadrupole mass spectrometer is thought to occur when ions q of ~0.907 gain significant radial amplitude. In the exit fringing field of the device, ions with large radial trajectories are subjected to intense axial fields, and thus, these ions emerge with large exit axial kinetic energies. The fact that the phenomenon responsible for mass resolution of an RF-only quadrupole occurs at the exit of the device rather than throughout the length of the rod structure means that mechanical tolerances are significantly relaxed with respect to those of a conventional RF/DC quadrupole mass spectrometer.

The ions near q~0.907 that have higher exit axial kinetic energies than the lower q ions can be detected preferentially by virtue of this excess axial kinetic energy. In practice energy filtering is accomplished by the placement of a retarding grid either at the exit of the quadrupole or further downstream. Particles are detected when:

$$(mv_n^2)/2>eV_r \quad (2)$$

where m is the mass of the ion, e is the charge on the ion, $v_n$ is the ion velocity normal to the grid plane, and $V_r$ is the retarding potential applied to the grid. Ion optic elements other than a planar grid can also be employed with varying efficiencies.

Figure 2A:
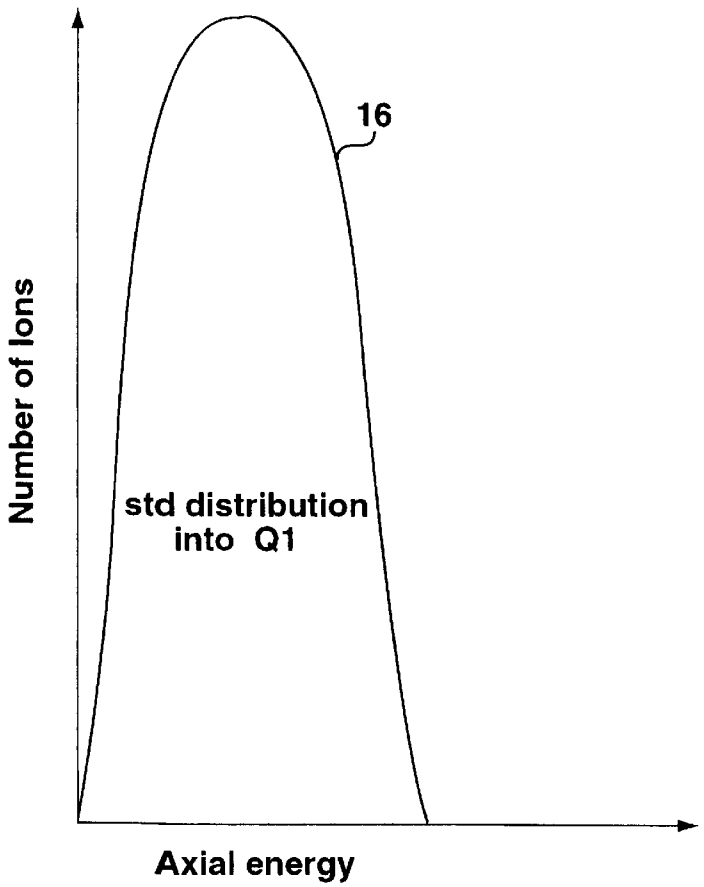
FIGS. 2*a* and 2*b* are graphs showing the variation number of ions detected with energy for different modes of operation.
Figure 2B:
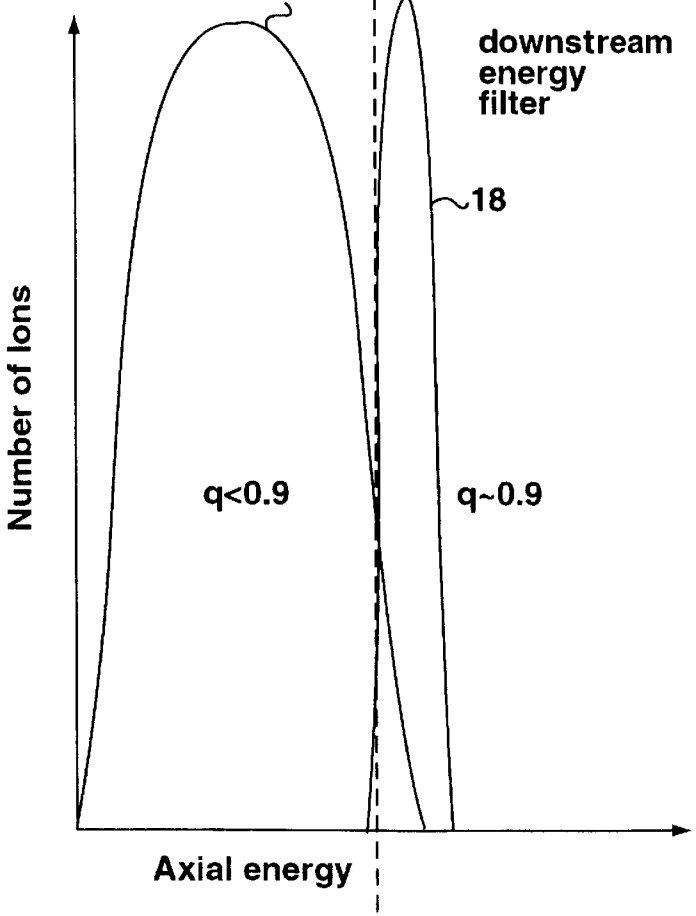

The energy considerations are illustrated in FIGS. 2*a* and 2*b*. FIG. 2*a* shows the standard axial energy distribution 16 of ions introduced into an RF-only quadrupole rod set, plotted against the number of ions. The shape of the energy distribution will depend on a number of factors such as the nature of the ion source and the ion optics in front of the quadrupole rods.

FIG. 2*b* shows the curve 16 from FIG. 2*a* and also the curve representing the distribution of axial energies 18 of ions whose q is about 0.9 and which therefore have received additional axial energy in the exit fringing field at the end of the RF-only quadrupole rods. If there is sufficient separation between the two curves energy filtering using a grid can be made very efficient, and only the ions that have gained axial kinetic energy in the exit fringing field are detected. A mass spectrum can be obtained in this way, by scanning the RF voltage applied to the quadrupole rods to bring the q of ions of various masses to near 0.907, at which time the large radial energies which they acquire yield increase axial energies, so these ions can be separated.

A drawback associated with this energy filtering technique is that there can be a significant high energy tail in the energy distribution 16 of ions entering the quadrupole rods. These high energy ions can originate in the ion source itself, the ion optics used to transport the ions from the source to the quadrupole rods, or from physical and chemical changes (such as metastable decomposition or collision-induced fragmentation) of the ion from the ion source to the quadrupole rods. This results in significant overlap of the curves 16 and 18 represented in FIG. 2*b* and thus the appearance of a continuum background signal upon which rides the resolved peaks from the ions with a q near 0.907. Higher mass ions with q<0.9 but with some radial excitation can also contribute to background ion current. The combination of these effects can lead to poor signal-to-noise ratio and a reduced analytical performance.

The problem of an underlying continuum background can be significant and performance limiting for the case of ions introduced from atmosphere using electrospray or atmospheric chemical ionization. These devices can produce ions and ionic clusters of widely varying sizes and energies. Optimum performance characteristics, as defined by the highest signal-to-noise ratio after mass analysis, is obtained by declustering the larger species through a combination of countercurrent gasses, heating, and collision-induced dissociation prior to the quadrupole rods. In the case of the present apparatus, a countercurrent (or curtain) gas flow and collision-induced cluster dissociation is employed in a differentially pumped region to maximize the intensity of the ion of interest. These conditions, which are typical of instruments of this type, can result in a very broad background ion signal when operating the quadrupole in RF-only mode. Furthermore this broad background has been found to be sample and solvent dependent and can severely reduce the RF-only signal-to-noise ratio.

Figure 3:
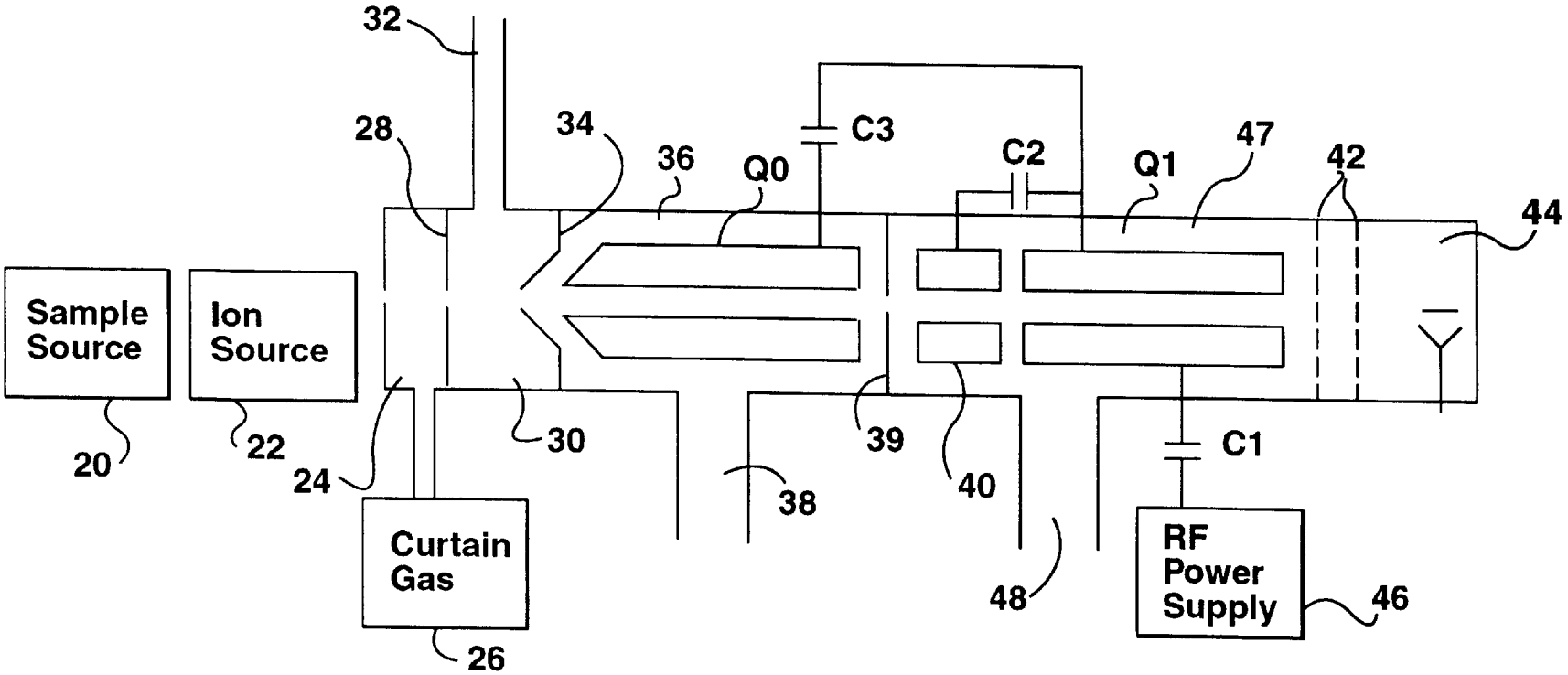
FIG. 3 is a schematic diagram of a mass spectrometer in accordance with the present invention.

Reference will now be made to FIG. 3, which shows an apparatus or quadrupole mass analyzer in accordance with the present invention. A sample source 20 supplies sample to an ion source 22 which can be an electrospray source. The source 22 produces ions and directs them through an orifice into an interface 24 region which may be supplied with inert curtain gas 26 as shown in U.S. Pat. No. 4,137,750, to assist in removing remaining solvent. Ions passing through the gas curtain travel through a further orifice 28 into a differentially pumped region 30, which is maintained at a pressure of about 1.5 Torr by a roughing pump as indicated by a pump connection 32.

The ions then pass through an orifice in a skimmer plate 34 and enter a first quadrupole RF-only rod set Q0 in a first chamber 36, which is pumped to a variable pressure; a pump connection is indicated at 38. Rod set Q0 serves to transmit the ions onward with the removal of some gas. While the first rod set Q0 is shown as a quadrupole rod set, it is to be appreciated that the rod set could be any suitable multipole rod set.

From chamber 36, the ions travel through an orifice in an interface plate 39 and through a short set of RF-only rods 40 into a set of analyzing rods Q1. The short RF-only rods 40 serve to collimate the ions travelling into the analyzing quadrupole Q1. A conventional energy filter 42, consisting of a pair of grids, is located downstream of the analyzing rods Q1, in the ion path, followed by a conventional detector 44.

The rods of Q0 may typically be about 10 cm long, the rods 40 may be typically 24 mm long, and the Q1 rods may typically be 127 mm in length. The rods have a radius of 0.47 cm and an inscribed radius of 0.418 cm. The rods Q1 are supplied with RF through capacitor C1 from a power supply 46. The same RF is supplied through capacitors C2, C3 from rods Q1 to rods Q0 and rods 40. Conventional DC offsets are also applied to the various rods and to the interface plates from a DC power supply (not shown).

The apparatus described above can produce a mass spectrum as the RF on the analyzing rods is scanned. As mentioned, ions approaching a q of 0.907 receive additional axial kinetic energy coupled from their radial energy in the exit fringing field at the exit of the analyzing rods Q1 and are able to surmount the potential barrier created by the energy filter 42 and can reach the detector 44. Ions with $q<0.907$ can also pass through the energy filter if their kinetic energy is sufficient. These ions do not gain significant energy in the exit fringing field, but as mentioned, for a variety of reasons, undesired ions might have sufficient energy to pass through the energy filter 42. Such ions will be observed as a rather featureless background contribution to the mass spectrum.

The rod sets 40 and Q1 are located in a chamber 47 with other downstream components. Like the chamber 36, the second chamber 47 is provided with a pump connection indicated at 48. In known manner, the two pump connection 38, 40 would be connected to a suitable pump, capable of generating a high degree of vacuum, and commonly this pump is backed up by a roughing pump which serves to pump the differentially pumped region 30. For conventional quadrupole operation, the chambers 36 and 47 are maintained at pressures of $7\times10^{-3}$ torr and $2\times10^{-5}$ torr respectively.

Reference will now made to FIGS. 4–8, which show the effect of gradually increasing the pressure in the first chamber 36.

Figure 6:
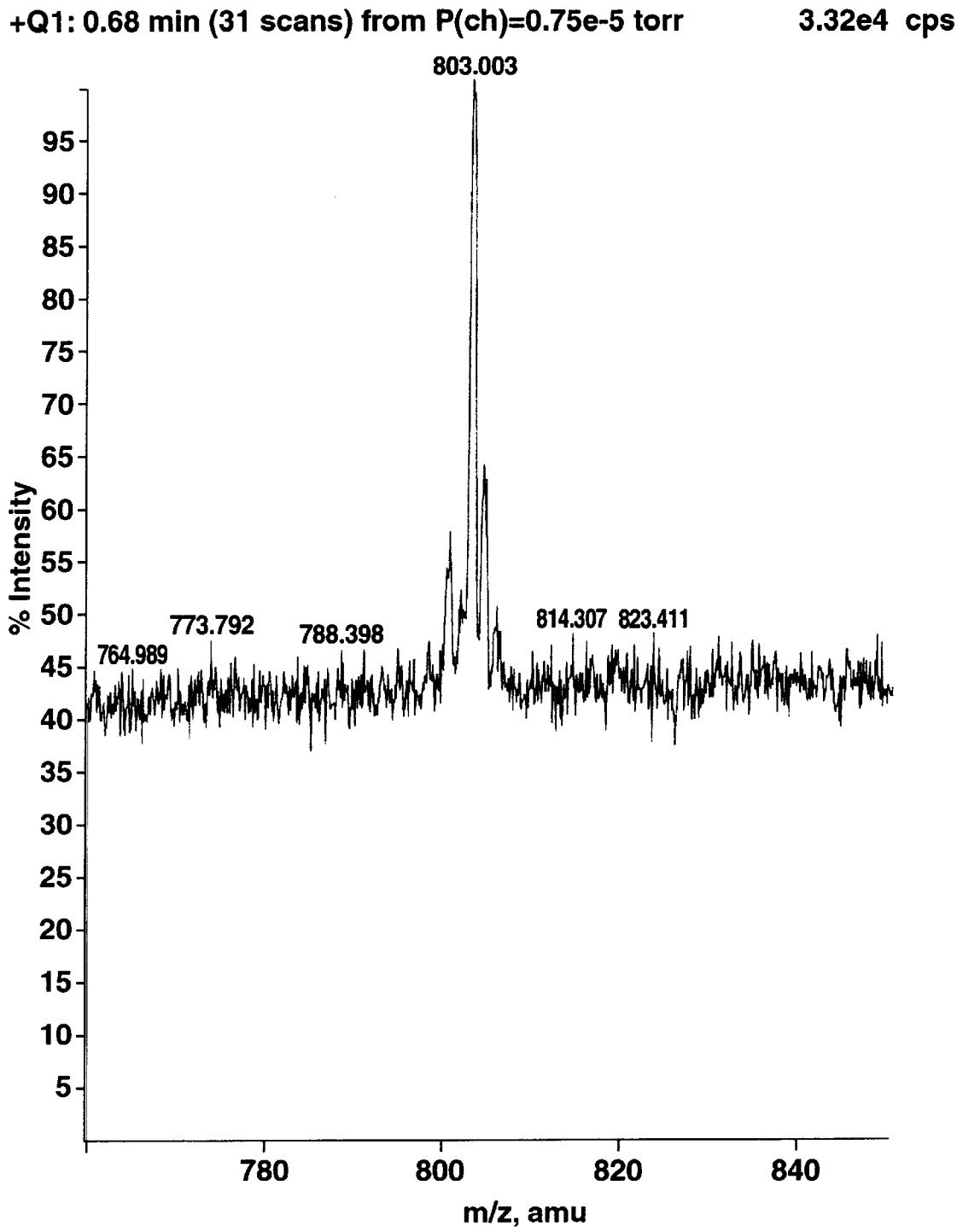
Figure 7:
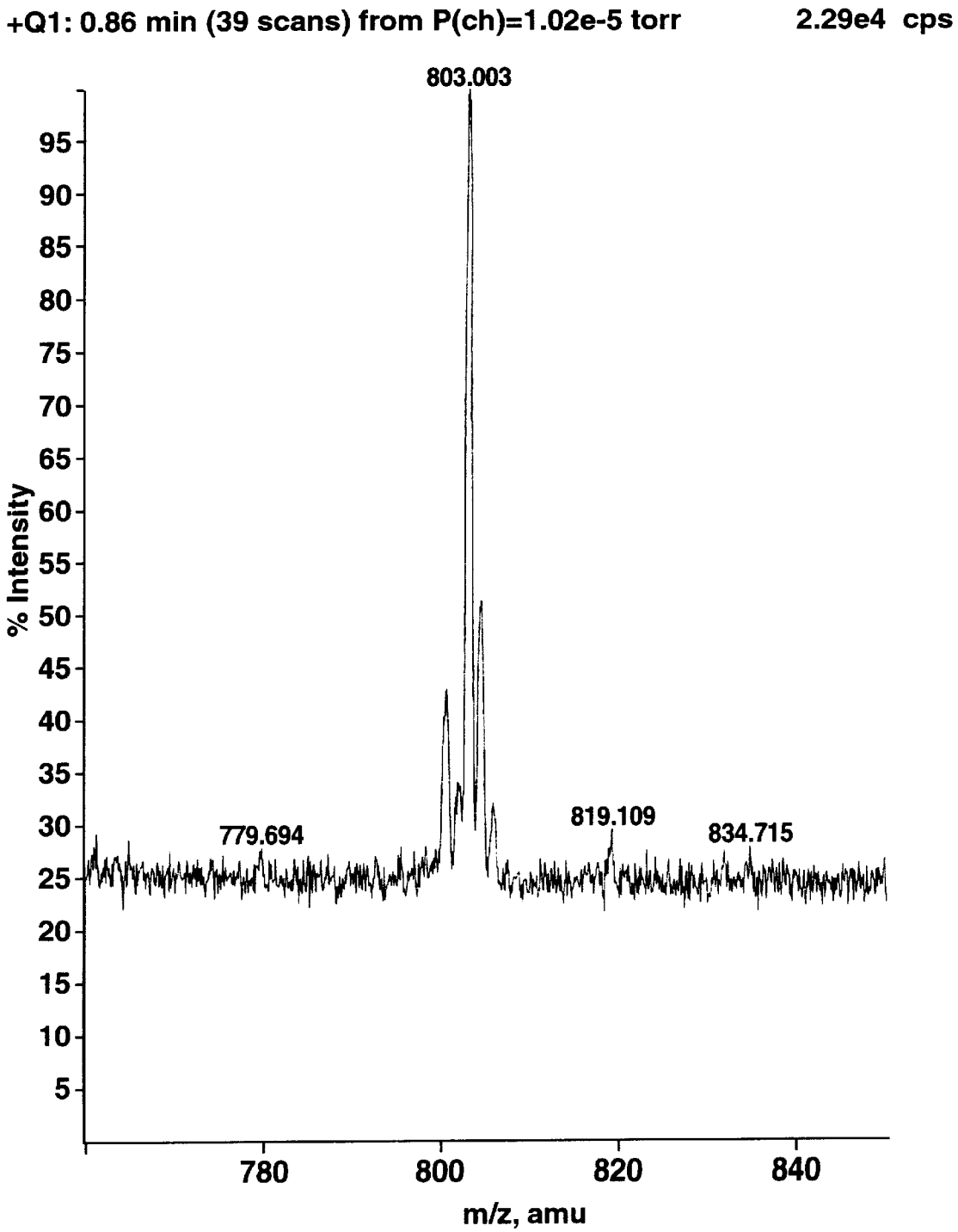
Figure 8:
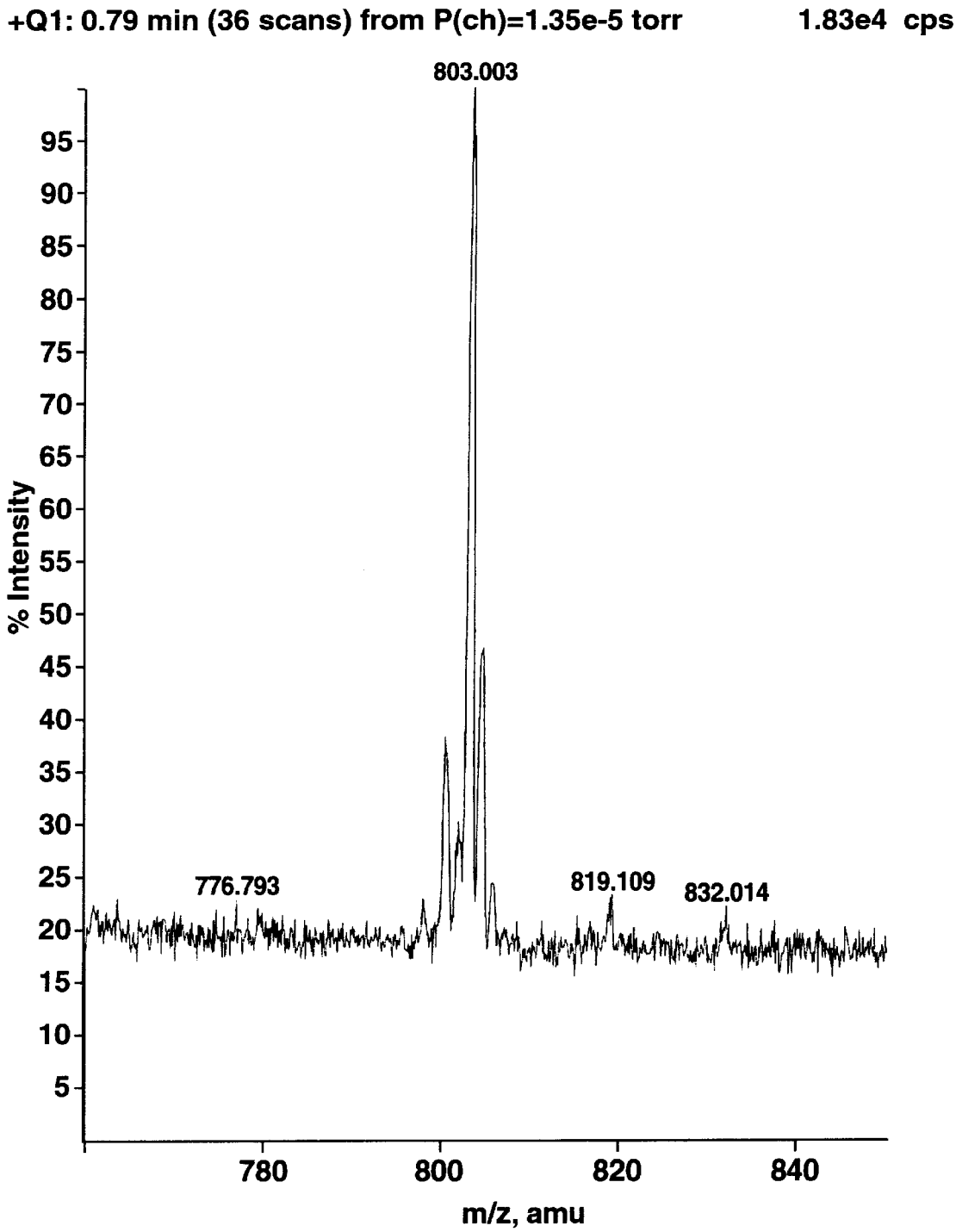

For the examples of FIGS. 4 to 8, the analyte sample in this illustration is reserpine (MW 609) at a concentration of 100 pg/$\mu$L in a solution of 22:51:33:1 ethanol:methanol:water:isopropanol and 0.1% formic acid. The sample was introduced via a pneumatically assisted electrospray ion source 22. The spectrum in FIG. 4 was obtained with a pressure of $4.1\times10^{-3}$ torr in the first chamber 36 around Q0, and resulted in a signal-to-background ratio of approximately 1:5. Since the instrument was not calibrated the reserpine signal appears at approximately 803 Daltons. When the pressure in chamber 36 was increased to $5.9\times10^{-3}$ torr the signal-to-background ratio increased to about 1:3 as shown FIG. 5. FIG. 6 shows that a further increase in the pressure in the chamber 36 to $9.0\times10^{-3}$ torr yielded a signal-to-background ratio of slightly better than 1:1. FIG. 7 shows that a pressure in chamber 36 of $1.23\times10^{-2}$ torr further enhances the signal-to-background ratio to 3:1. FIG. 8 shows that a signal-to-background ratio of 5:1 can be obtained with a pressure in chamber 36 of $1.63\times10^{-2}$ torr. As is known due to gas leakage between chambers 36 and 47, the pressure in chamber 47 increased from $0.34\times10^{-5}$ torr to $1.02\times10^{-5}$ torr for these experiments; this range of pressures is so low that this gas has an insignificant effect in Q1.

Table 1 summarizes the analyte and background levels seen in FIGS. 4–8. The reported analyte intensities have been background subtracted.

TABLE 1

| Pressure (torr) in chamber 36 (rod set Q0) | Q0 Pressure × Length (torr-cm) | Reserpine Intensity (cps) | Background Intensity (cps) |
|---|---|---|---|
| $4.1\times10^{-3}$ | $4.1\times10^{-2}$ | $2.29\times10^{4}$ | $1.04\times10^{5}$ |
| $5.9\times10^{-3}$ | $5.9\times10^{-2}$ | $2.04\times10^{4}$ | $5.24\times10^{4}$ |
| $9.0\times10^{-3}$ | $9.0\times10^{-2}$ | $1.93\times10^{4}$ | $1.39\times10^{4}$ |
| $1.23\times10^{-2}$ | $1.23\times10^{-1}$ | $1.72\times10^{4}$ | $5.73\times10^{3}$ |
| $1.63\times10^{-2}$ | $1.63\times10^{-1}$ | $1.53\times10^{4}$ | $3.02\times10^{3}$ |

Figure 4:
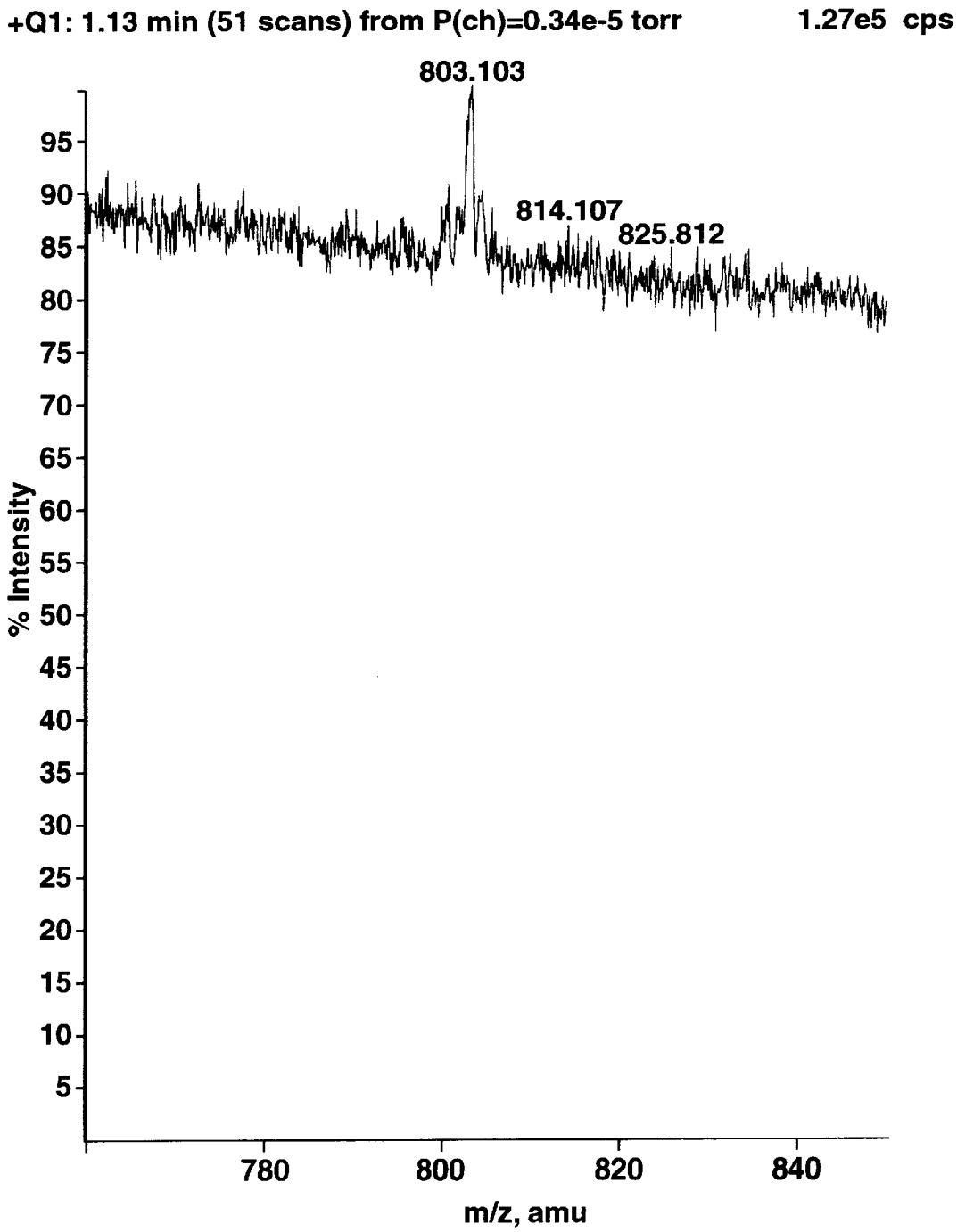
FIGS. 4–8 show the effect of increasing the pressure in the first chamber of the quadrupole mass analyzer of FIG. 3.
Figure 5:
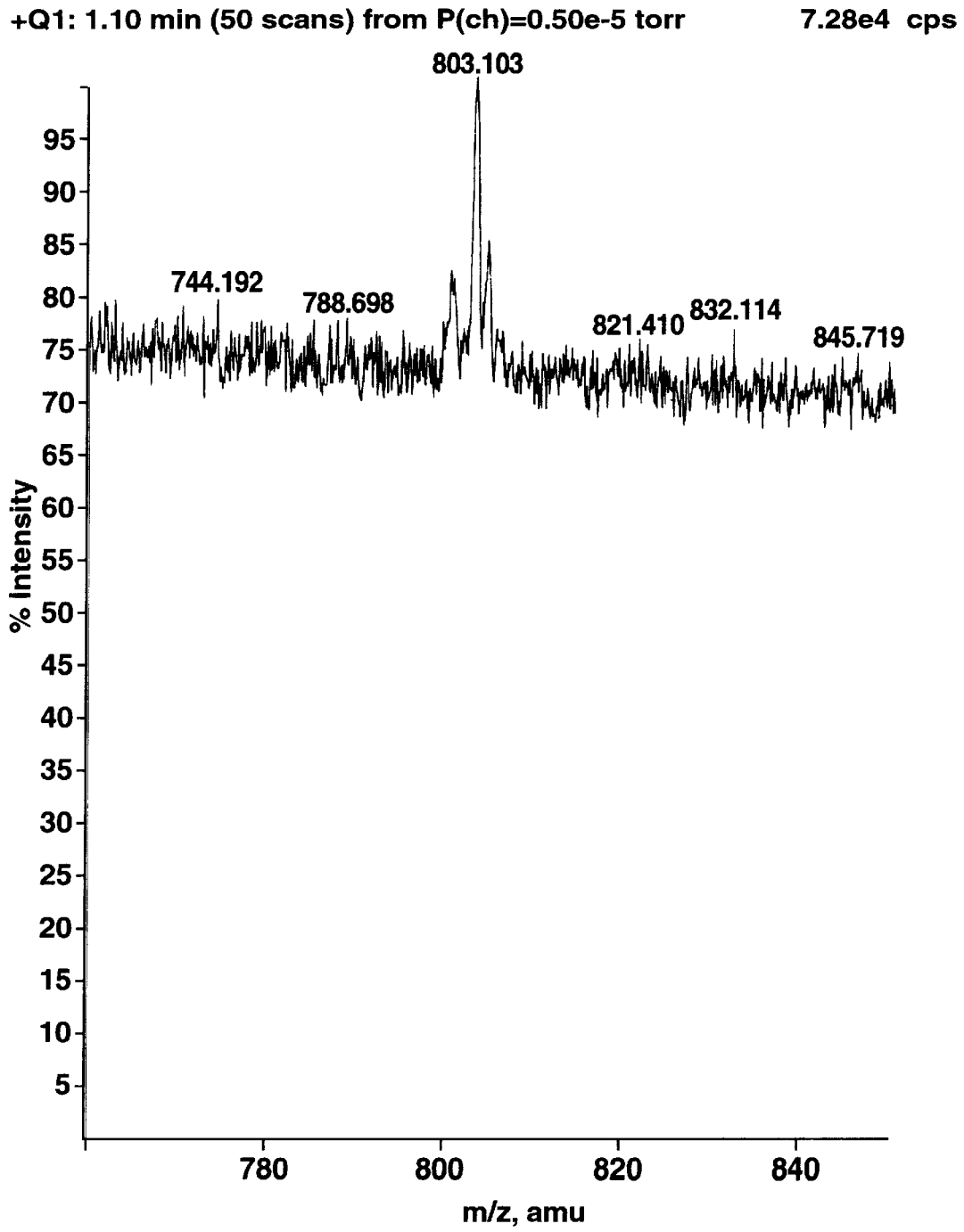

The data above shows a dramatic reduction in the continuum background in the RF-only mass spectra from a value of approximately $1\times10^{5}$ counts/sec in FIG. 4 to about $3\times10^{3}$ counts/sec in FIG. 8. This reduction in the background is by a factor of about thirty five. The background corrected analyte intensity on the other hand shows only a marginal decrease of about 30%. Thus the detectability of the analyte in this illustration has been considerably enhanced by operating the Q0 chamber at elevated pressures while Q1 is operated as an RF-only mass analyzer.

The fact that higher pressures in chamber 36 reduce the RF-only background while leaving the analyte intensity unaffected suggests that the source of the background is higher mass-to-charge species with sufficient kinetic energy to surmount the repulsive barrier at the exit of the quadruple rods. These are probably ions and ionic clusters that have been accelerated to high kinetic energies in the atmospheric pressure-to-vacuum interface region by the declustering voltages. Q0 chamber pressures in the millitorr regime result in increased momentum dissipating collisions that narrows the energy distribution of the ionic species that contribute to the broad featureless background observed in the RF-only mass spectrum. Thus better energy discrimination between the ions with q~0.907 and those at lower q values can be effected. The number of collisions an ion has in the Q0 chamber is proportional to the pressure of the chamber multiplied by the length of the Q0 rod array. These values are also presented in Table 1 above.

Addition of modifiers to the solvent such as acids and buffers cause this background to increase. These solvent modifiers are known to increase the production of gas phase clusters in electrospray ionization techniques, which also confirms the analysis it is high m/z ions and ionic clusters that create the unwanted background signal. High declustering voltages between orifices 28 and 34 also increase the contribution of the broad continuum ion signal since, in this region, multiply charged ions and ionic clusters are accelerated to proportionally higher kinetic energies than singly charged species.

U.S. Pat. No. 4,963,736 teaches that a pressurized AC-only section, similar to the Q0 section here, placed in front of a conventional RF/DC quadrupole mass analyzer results in higher analyte ion signal, better sensitivity at high masses, fewer focusing aberrations and the ability to use smaller less costly vacuum pumps. However, there is no mention of background reduction in U.S. Pat. No. 4,963,736. This is probably because continuum background is not normally a problem with conventional RF/DC quadrupoles operating near the apex of the stability diagram because of the very small transmission bandpass of such mass analyzers. RF-only mass spectrometers that operate near the 0.907 stability boundary are very broad bandpass filters. Thus these mass analyzers are inherently different from RF/DC quadrupoles and suffer from a different suite of performance limitations, high continuum background being one of them. The energy difference between the analyte species and the ionic species giving rise to the unresolved background seen with an RF-only mass analyzer is the source of a significant limitation in terms of signal-to-noise. A pressurized Q0 region serves to minimize the energy differences between the analyte and the background-inducing species.

While the specific embodiment shows two quadrupole rod sets Q0, Q1, it is to be understood that any suitable multipole rod set could be used for Q0, which serves to narrow the energy distribution of the ions entering Q1 and possibly break up ion clusters by increased collisions with the gas in chamber 36. This is based on the mechanism believed to be responsible for enhancing the effect of this invention, namely the reduction in the background level, but it is to be noted that the invention is not to be limited to this suggested mechanism. Thus, it is believed that other pressurized multipole devices, such as a hexapole or an octapole, would give similar performance enhancements when operated in the Q0 position.

What is claimed is:

1. A method of mass analysis utilizing a quadrupole rod set located in a vacuum chamber, the method comprising:

(1) providing a stream of ions and supplying the stream of ions to one end of a first multipole rod set;

(2) supply an RF-only voltage to the multipole rod set, whereby the first multipole rod set acts as an ion guide and transmits desired ions therethrough;

(3) passing the ions into an analyzing quadrupole rod set;

(4) supplying an RF-only voltage to the analyzing quadrupole rod set, whereby desired ions having a mass-to-charge ratio giving a q value of substantially 0.907 gain additional axial kinetic energy upon leaving the analyzing quadrupole rod set;

(5) detecting ions leaving the analyzing quadrupole rod set having the increased axial kinetic energy; and (6) selecting the pressure within the first multipole rod set to enhance separation between ions gaining the additional axial kinetic energy and other ions.

2. A method as claimed in claim 1, wherein step (5) comprises:

(a) passing ions leaving the analyzing quadrupole rod set through an energy filter, whereby only ions with additional axial kinetic energy have sufficient energy to pass through the energy filter; and (b) detecting ions passing through the energy filter at a detector.

3. A method as claimed in claim 2, which comprises providing a gas pressure in the multipole rod set such that the multiple of the pressure in the multipole rod set times the length of the multipole rod set is at least $4\times10^{-2}$ torr-cm.

4. A method as claimed in claim 3, wherein the pressure in the multipole rod set is such as to maintain a multiple of the pressure times the length in the multipole rod set of at least $10^{-1}$ torr-cm.

5. A method as claimed in claim 4, wherein the pressure in the multipole rod set is such as to maintain a multiple of the pressure times the length in the multipole rod set of equal to or greater than $1.6\times10^{-1}$ torr-cm.

6. A method as claimed in claim 3, 4 and 5, wherein the multipole rod set is a first quadrupole rod set and wherein the first quadrupole rod set is 10 cm long.

7. A method as claimed in claim 2, which includes generating ions at atmospheric pressure and passing the ions into the multipole rod set.

8. A method as claimed in claim 7, which includes generating ions by an atmospheric electrospray source and passing ions through a gas curtain to form the ion stream.

9. A method as claimed in claim 8, which includes passing ions leaving the gas curtain through a differentially pumped region and then through a skimmer into the multipole rod set.

10. A method as claimed in claim 9, which includes providing the multipole rod set in a first chamber and providing the analyzing quadrupole rod set in a second chamber, the second chamber being maintained at a lower pressure than the first chamber.

11. A method as claimed in claim 10, which includes providing the energy filter as a pair of grids in the second chamber and providing the detector in the second chamber.

12. A method as claimed in claim 1, 2, 8 or 10 wherein the multipole rod set comprises a first quadrupole rod set.

13. An apparatus for mass analysis of an ion stream, the apparatus comprising:

a generation means for generating a stream of ions;

a multipole rod set connected to the generation means for receiving ions and for collimating and cooling ions;

an analyzing quadrupole rod set having an inlet for the ion stream from the multipole rod set and an outlet;

a means for maintaining a variable pressure in the multipole rod set and adjusting the pressure to improve separation, in the analyzing quadrupole rod set, between ions with a q of substantially 0.907 and other ions, the ions having a q of substantially 0.907 gaining axial kinetic energy on leaving the outlet of the analyzing quadrupole rod set; and a means for detecting the ions having the additional axial kinetic energy, whereby ions having the higher axial kinetic energy are resolved with respect to other ions.

14. An apparatus as claimed in claim 13, which includes, as the means for detecting the ions with a higher axial kinetic energy, an energy filter and a detector at the outlet of the analyzing quadrupole rod set.

15. An apparatus as claimed in claim 13, wherein the means for maintaining a variable pressure within the multipole rod set maintains a pressure giving a multiple of the rod length and pressure in the multipole rod set of at least $4\times10^{-2}$ torr-cm.

16. An apparatus as claimed in claim 13, wherein the means for maintaining a variable pressure within the multipole rod set maintains a pressure giving a multiple of the length times the pressure of the multipole rod set of at least $10^{-1}$ torr-cm.

17. An apparatus as claimed in claim 13, wherein the means for maintaining a variable pressure in the multipole rod set maintains a pressure giving a multiple of the rod length times the pressure of the multipole rod set of greater than or equal to $1.6\times10^{-1}$ torr-cm.

18. An apparatus as claimed in claim 14, which includes a first chamber in which the multipole rod set is located and a second chamber in which the analyzing quadrupole rod set is located, whereby different pressures can be maintained in the first and second chambers.

19. An apparatus as claimed in claim 18, wherein the generation means comprises an atmospheric electrospray source, wherein a curtain gas region is provided immediately adjacent to the generation means and a differentially pumped region is provided between the curtain gas region and the first chamber.

20. An apparatus as claimed in claim 19, wherein the means for detecting ions comprises a pair of grids, the pair of grids and the detector being located in the second chamber.

21. An apparatus as claimed in claim 19, wherein the multipole rod set comprises a first quadrupole rod set.

* * * * *